United States Patent [19]

Rink

[11] 4,394,622

[45] Jul. 19, 1983

[54] HIGH VOLTAGE COAXIAL SWITCH

[76] Inventor: John P. Rink, Los Alamos, N. Mex., granted to U.S. Department of Energy under the provisions of 42 U.S.C. 2182

[21] Appl. No.: 269,457

[22] Filed: Jun. 3, 1981

[51] Int. Cl.[3] ..... H01J 17/00; H01J 25/34

[52] U.S. Cl. ..... 377/115; 315/39; 315/336; 313/234; 313/309; 333/13

[58] Field of Search ..... 315/39, 326; 333/13, 333/262; 313/103 R, 234, 309; 328/251

[56] References Cited

U.S. PATENT DOCUMENTS

| | | | |
|---|---|---|---|
| 3,309,561 | 3/1967 | Kane | 315/39 |
| 3,980,920 | 9/1976 | Dudley et al. | 313/103 H |
| 4,198,590 | 4/1980 | Harris | 313/306 |
| 4,291,255 | 9/1981 | Alexeff | 315/326 |

*Primary Examiner*—Stanley D. Miller

*Assistant Examiner*—B. P. Davis

*Attorney, Agent, or Firm*—Leonard C. Brenner; Paul D. Gaetjens; Richard G. Besha

[57] ABSTRACT

A coaxial high voltage, high current switch having a solid cylindrical cold cathode coaxially surrounded by a thin hollow cylindrical inner electrode and a larger hollow cylindrical outer electrode. A high voltage trigger between the cathode and the inner electrode causes electrons to be emitted from the cathode and flow to the inner electrode preferably through a vacuum. Some of the electrons penetrate the inner electrode and cause a volumetric discharge in the gas (which may be merely air) between the inner and outer electrodes. The discharge provides a low impedance path between a high voltage charge placed on the outer electrode and a load (which may be a high power laser) coupled to the inner electrode. For high repetition rate the gas between the inner and outer electrodes may be continuously exchanged or refreshed under pressure.

12 Claims, 3 Drawing Figures

HIGH VOLTAGE COAXIAL SWITCH

This invention is a result of a contract with the U.S. Department of Energy (Contract No. W-7405-ENG-36).

BACKGROUND OF THE INVENTION

The present invention relates generally to high speed switching of high voltage, high current electrical pulses and more particularly to reliable fast switching of voltages and currents beyond the range of commercially available thyratrons such as for use in triggering high power ultraviolet lasers and in other applications.

Moderately high voltages and high currents can be switched rapidly and fairly reliably with conventional commercially available silicon-controlled rectifiers (SCRs), thyratrons and the like. To rapidly switch very high voltages a spark gap method is employed wherein a high voltage differential is applied between two relatively closely spaced electrodes causing a rapid switching spark to occur therebetween. The electrical action occurring is quite similar to the functioning of a spark plug in the engine of a conventional gasoline motor. The spacing of the electrodes is primarily a function of the voltage differential therebetween and the nature of the gas, air, or other intervening environment.

Problems are inherent in spark gap switches however. First the electrodes erode under continuous sparking and are relatively short-lived under heavy duty operation requiring frequent maintenance and replacement. Also, the spark timing is not precise leading to pulse jitter. Another problem that occurs with spark gap switches at high frequency or repetition rate operation is that the environment between the electrodes becomes in effect contaminated by the spark and requires a finite time to re-stabilize. To speed up reliable spark gap action a procedure has been developed whereby the gas or other interelectrode medium is flowed past the spark electrode to maintain a relatively constant pure medium between the electrodes at all times. At high spark rates, in and above the kilohertz range, the volume and rate of medium exhange flow becomes quite high and introduces an additional ancillary burden in the attempt to achieve a reliable stable high voltage, high current pulse.

SUMMARY OF THE INVENTION

It is therefore an object of the present invention to provide a reliable high voltage, high current, high repetition rate switch suitable for triggering ultraviolet lasers and the like.

It is another object of the present invention to provide a long-lived high voltage, high current switch free from spark erosions and other highly deteriorating mechanisms.

It is still another object of the present invention to provide a stable reliable relatively jitter free high voltage, high current switch.

In accordance with the present invention there is provided a solid metallic cold cathode round cylinder having a plurality of sharp points for emitting electrons therefrom, a first hollow thin-walled cylinder coaxial with the cathode and a larger diameter second hollow cylinder surrounding the first cylinder and being also coaxial with the cathode. The area between the cathode and the first cylinder is evacuated down to a few microns and the area between the first and second cylinders is filled with air or other gases having appropriate discharge parameters. Preferably provision is made to flow the air or other gases through the area between the first and second cylinder, especially when a high switching rate is required.

In operation, a high voltage electrical charge is placed on the second cylinder followed by a high voltage trigger pulse applied to the cold cathode which causes electrons to be emitted from the sharp points thereon to flow to the first cylinder and through a small capacitor back to the high voltage trigger source. Some of the emitted electrons penetrate the first cylinder thereby producing secondary electrons and generating a large volumetric discharge in the region between the first and second cylinder thus switching the high voltage electrical charge from the second cylinder to the first cylinder and from there through appropriate cabling to the load which may be a high power laser or the like.

An advantage of the present invention is that a cold cathode and field emission is used for the initial triggering pulse thereby eliminating the erosive and other deteriorating effects of a conventional spark trigger.

Another advantage of the present invention is that the coaxial design thereof induces a uniform volumetric discharge rather than a spot discharge and provides for reliable high repetition switching rates under relatively low interelectrode gas exchange flow rates and pressure.

Still another advantage of the present invention is that the coaxial design arrangement thereof yields a low inductance, low jitter, high voltage, high current switch that may be readily scaled up or down depending upon particular switching power requirements.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF A PREFERRED EMBODIMENT OF THE INVENTION

Figure 1:
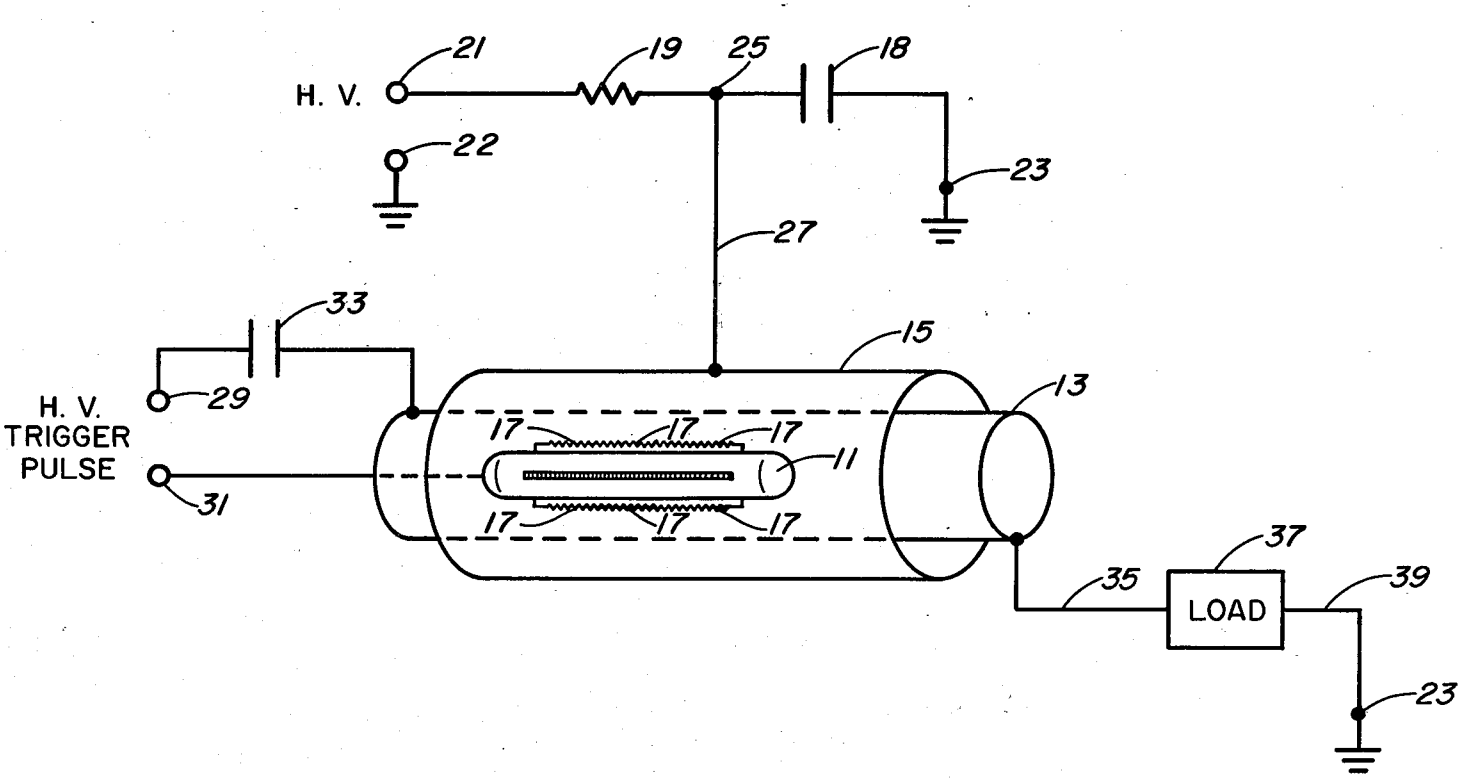
FIG. 1 is a diagram illustrating the electrical switching arrangement of the invention.

Reference is now made to FIG. 1 which shows a preferred embodiment of an apparatus in accordance with the present invention. A solid cylindrical cathode 11 is coaxially surrounded by a thin, hollow cylindrical electrode 13 and a larger hollow cylindrical outer electrode 15. The cathode 11 has a plurality of sharp points 17 thereon. As will be detailed hereinafter, a vacuum is maintained between the cathode 11 and the inner cylindrical electrode 13 while a gas which may be air either fills or is flowed between the inner electrode 13 and the outer electrode 15.

To operate the switch, a high-voltage charge is placed upon the outer electrode 15. This is accomplished by charging capacitor 18 through resistor 19 by the application of high voltage applied between high voltage terminal 21 and ground terminal 23. The junction 25 between the capacitor 18 and the resistor 19 is connected through lead 27 to the outer cylindrical electrode 15. The capacitor 18 is connected between the junction point 25 and ground 23. After the outer electrode 15 is charged, a high voltage trigger pulse is applied between terminals 29 and 31. Terminal 29 is connected through a small capacitor 33 to the inner electrode 13 while terminal 31 is connected directly to cathode 11. With the high voltage trigger pulse applied, the cathode 11 functions as a cold cathode and electrons are emitted therefrom most notably off of the sharp points 17 thereon. The electrons so emitted flow to the inner electrode 13 and complete the primary path through capacitor 33 back to the high voltage trigger pulse terminal 29. However, some of the emitted electrons penetrate through the thin hollow cylindrical electrode 13 to generate a sufficient number of secondary electrons to produce a large volumetric discharge between the inner electrode 13 and the outer electrode 15. The discharge action permits the high voltage charge placed on cylinder 15 to be in essence switched to cylinder 13 and through cable 35 to load 37 which has a return cable 39 to ground 23. By the action thus described, a very high energy charge is reliably switched or triggered to load 37 which may be, for example, an ultraviolet high-powered laser.

Figure 2:
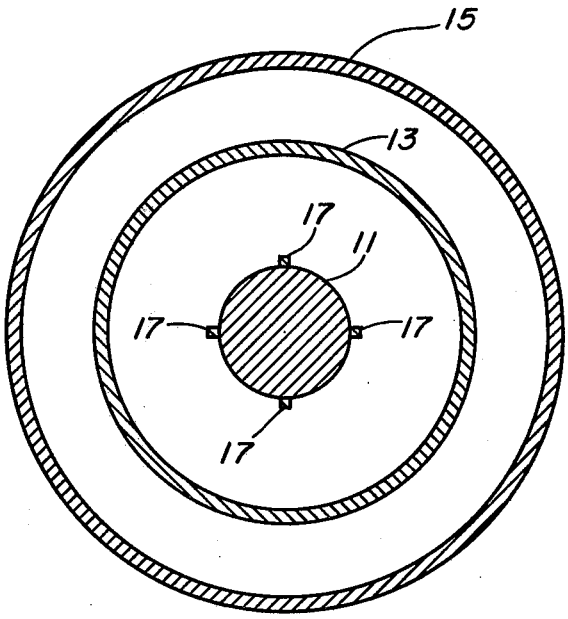
FIG. 2 is a cross-sectioned diagram of a solid cathode and two hollow cylindrical electrodes as coaxially arranged in accordance with the present invention.

With reference now to FIG. 2, the coaxial arrangement and structure of the present invention can be fully appreciated. The cold cathode 11 is coaxially surrounded by the thin, hollow cylinder 13 which is in turn coaxially surrounded by the outer cylindrical electrode 15. The sharp points 17 on the cathode 11 are quadrantly placed as shown in FIG. 2. Such placement of the sharp points 17 assure a rather uniform discharge of electrons from the cathode 11 to the inner electrode 13. It can be appreciated that the circular cross-section of electrodes 13 and 15 inherently provide for a uniform discharge therebetween.

Figure 3:
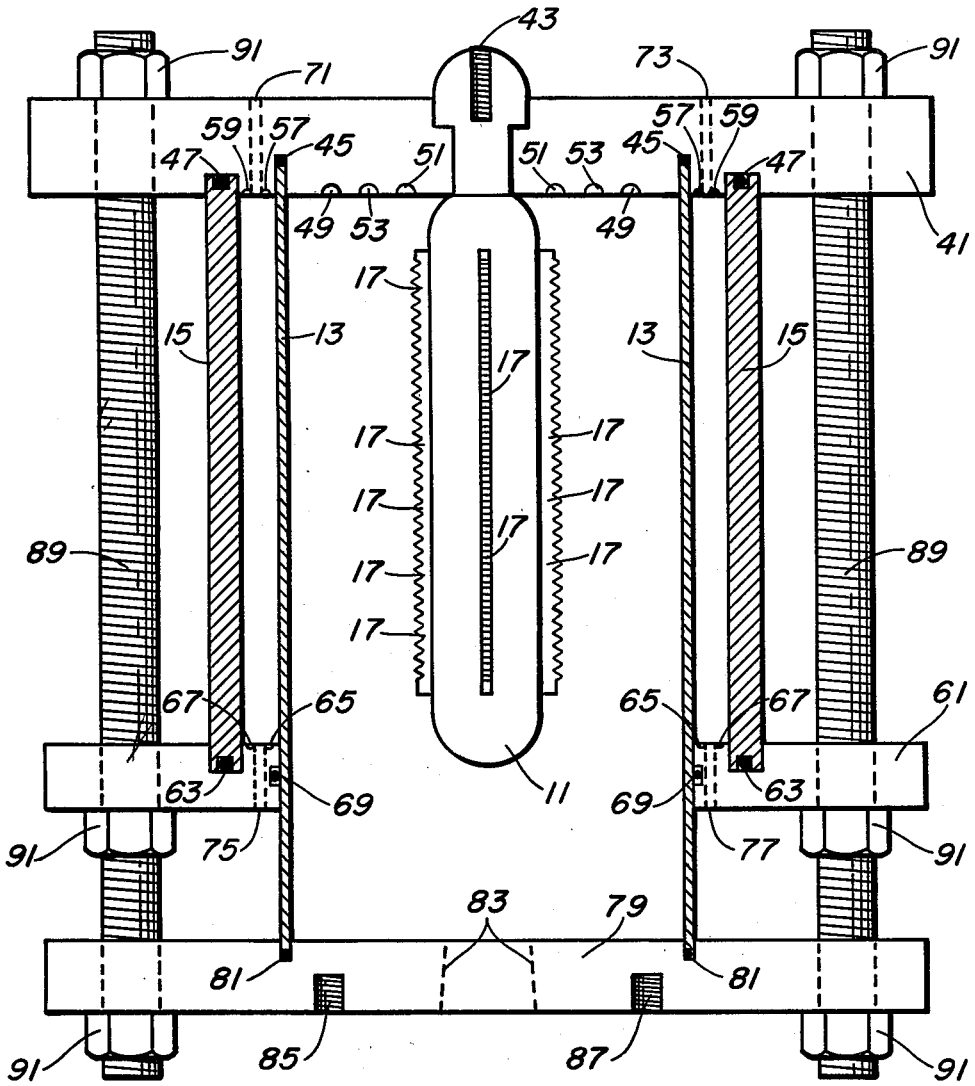
FIG. 3 is a cross-sectioned side view diagram detailing the preferred structural arrangement of the components of the present invention.

With reference now to FIG. 3, it can be appreciated that the cold cathode 11 is secured in a nonconductive circular top plate 41. A threaded receptacle is provided on the cathode 11 for electrical coupling thereto. The nonconductive circular top plate 41 is further grooved to receive the cylindrical electrodes 13 and 15. O-rings 45 and 47 are provided respectively to assure an airtight seal. A plurality of circular grooves 49, 51 and 53 are cut into the nonconductive circular top plate 41 in order to prevent surface tracking and misfires between the cold cathode 11 and the inner electrode 13. Likewise, grooves 57 and 59 are provided in top plate 41 to prevent surface tracking and misfires between the inner electrode 13 and the outer electrode 15.

The outer electrode 15 is further secured in place by nonconductive circular bottom plate 61. As was done with the nonconductive circular top plate 41, an o-ring 63 is provided for the outer electrode 15 to assure an air tight mating and circular grooves 65 and 67 are provided to prevent surface tracking and misfiring between the inner electrode 13 and the outer electrode 15. Further, an o-ring 69 is provided to assure an air tight seal against the inner electrode 13. Small gas or air exchange ports 71 and 73 are cut through the circular nonconductive top plate 41 to permit a continuous exchange of gas or air under pressure therethrough. Preferably, similar air ports 75 and 77 are provided through the nonconductive circular bottom plate 61 so that the gas or air exchange may be made smoothly and continuously through the top plate 41 and out of the bottom plate 61. If the pulse rate is quite slow, on the order of one pulse per second, the air ports for a gas or air exchange 71, 73, 75, and 77 may not be needed and could be omitted.

The inner electrode 13 is further secured by conductive circular bottom plate 79. An o-ring 81 is provided to assure an air tight connection between the conductive circular bottom plate 79 and the inner electrode 13. A vacuum port 83 is provided through the conductive circular bottom plate 79 so that a vacuum may be drawn in the cylindrical region bounded by the inner cylindrical electrode 13, the nonconductive circular top plate 41, and the conductive circular bottom plate 79. Preferably a vacuum is drawn through the port 83 down to a few microns. Also in the conductive circular bottom plate 79 there are provided two screw receptacles 85 and 87 for electrical connections thereto.

Nonconductive screws 89 are inserted through the top plate 41, the nonconductive bottom plate 61, and the conductive bottom plate 79 and are held in place by a plurality of appropriately positioned nuts 91. For purposes of illustration, only two nonconductive screws 89 are detailed in FIG. 3, although it is appreciated that a plurality of screws up to and possibly exceeding eight in number may be placed evenly around the circumference of the nonconductive circular top plate 41, the nonconductive circular bottom plate 61, and the conductive circular bottom plate 79.

In one embodiment, such as that detailed in FIG. 2 and FIG. 3, it can be seen that the sharp points 17 on cold cathode 11 can be formed by the insertion of sharp pointed blades such as hacksaw blades into the otherwise smooth circumference of the cold cathode 11. In FIG. 2 and FIG. 3, four such hacksaw blade insertions to form the sharp points 17 are shown although as many as and perhaps more than eight hacksaw blades could be so utilized. Alternately, the smooth cold cathode 11 surface could be grooved into sharp areas by other conventional means.

The invention as detailed for one embodiment in FIGS. 1, 2, and 3 may be scaled as appropriate to any particular application. For example, the size of the cathode 11 and the inner electrode 13 need be only such as to assure sufficient electron emission from the cold cathode 11 to produce secondary electrons in the region between electrode 13 and electrode 15. The sizing therefor varies primarily as a function of the magnitude of the high voltage trigger applied to the cold cathode 11 and the material and thickness of the inner electrode 13. Likewise, the area in sizing between the inner electrode 13 and the outer electrode 15 can be varied depending primarily upon the nature of the gas or air in between and the magnitude of the high voltage charge placed upon the outer electrode 15. The constraint on sizing is such that the electrons penetrating electrode 13 are sufficient to initiate a volumetric discharge between the outer electrode 15 and the inner electrode 13.

For purposes of illustration and to better teach one embodiment of the invention, certain values will be hereinafter ascribed to the components shown in FIGS.

1, 2, and 3. The values so given are intended to illustrate merely one embodiment of the invention and not to limit the invention thereto. In FIG. 1, the resistor 19 may be in the order of 1 megohm, the capacitor 18 may be in the value of 0.04 microfarad, and the capacitor 33 may be in the order of 270 nanofarad. The high voltage trigger pulse applied between terminals 29 and 31 may be in the order of 20–100 kilovolts for a nanosecond pulse occurring at a repetition rate between 1 hertz and 10 kilohertz. The high voltage level applied between terminals 21 and 23 may be in the order of 1 kilovolt to 100 kilovolts. The load 37 may be, for example, a high powered ultraviolet laser.

As shown in FIG. 2, the cold cathode 11 may be fabricated of brass and be in the order of 1 inch in diameter. Hacksaw blades may be inserted in the cold cathode 11 to form the sharp points 17 in at least quadrants of the cold cathode 11. The inner electrode 13 may be in diameter approximately 2.5 inches and in thickness approximately 1/16 inch or less. The outer electrode 15 may also be fabricated from aluminum and could be in the order of 3.5 inches in diameter and ¼ inch in thickness.

With reference to FIG. 3, the nonconductive circular top plate can be in the order of 6 inches in diameter and 0.5 inches in thickness and fabricated from Lexan. The nonconductive circular bottom plate may also be in the order of 6 inches in diameter, 1 inch in thickness, and also constructed of Lexan. The conductive bottom plate 79 may be in the order of 6 inches in diameter, 0.5 inch in thickness, and fabricated from aluminum. The length of the cold cathode 11 beneath the circular top plate 41 may be 4.5 inches. The length of the inner electrode 13 may be 5.5 inches while the length of the outer electrode 15 may be 4.5 inches.

The foregoing description of a preferred embodiment of the invention has been presented for purposes of illustration and description. It is not intended to be exhaustive or to limit the invention to the precise form disclosed, and obviously many modifications and variations are possible in light of the above teaching. As an example, an outer cylinder coaxially surrounding the outer electrode 15 may be added and placed at ground potential for safety reasons, for completing the coaxial configuration, and for providing a switching device with the lowest possible inductance. Also, the high voltage provided to the outer electrode 15 may be provided from a pulsed power supply such as a resonant charging circuit particularly when switching repetition rates at or exceeding 100 Hz are required.

It can therefore be appreciated that the embodiment detailed above was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A high voltage coaxial switch comprising:
a circular cross-sectioned cylindrical cathode;
a thin walled hollow circular cross-sectional cylindrical inner electrode coaxially surrounding said cathode;
a hollow circular cross-sectional cylindrical outer electrode coaxially surrounding said inner electrode;
means for facilitating evacuation of the region between said cathode and said inner electrode;
means for facilitating provision of a gas to the region between said inner electrode and said outer electrode;
means for providing a high voltage charge to said outer electrode;
means for connecting a load to said inner electrode; and
means for providing a high voltage pulse between said cathode and said inner electrode to cause electrons to be emitted from said cathode and accelerated toward said inner electrode with sufficient quantities of electrons passing therethrough to cause secondary electron emission and a volumetric discharge in the region between said inner electrode and said outer electrode whereby a high voltage charge on said outer electrode is discharged to said inner electrode and through a load connected thereto.

2. The high voltage coaxial switch according to claim 1 wherein said circular cross-sectional cylindrical cathode is a cold cathode.

3. The high voltage coaxial switch according to claim 2 wherein said cold cathode has a plurality of points thereon to aid in electron emission therefrom.

4. The high voltage coaxial switch according to claim 3 wherein said plurality of points on said cold cathode are positioned so as to induce a relatively uniform electron emission in the region between said cold cathode and said inner electrode.

5. The high voltage coaxial switch according to claim 2 wherein said cold cathode is a solid circular cross-sectional cylindrical cold cathode.

6. The high voltage coaxial switch according to claim 5 wherein said solid circular cross-sectional cylindrical cold cathode is a solid brass circular cross-sectional cylindrical cold cathode.

7. The high voltage coaxial switch according to claim 2 wherein said thin walled hollow circular cross-sectional cylindrical inner electrode is fabricated from aluminum.

8. The high voltage coaxial switch according to claim 2 wherein said thin walled hollow circular cross-sectional cylindrical inner electrode has a wall no greater than approximately one-sixteenth inch thick.

9. A high voltage coaxial switch for discharging a highly charged electrode through a load, said high voltage coaxial switch comprising:
a solid brass circular cross-sectional cylindrical cold cathode;
an aluminum thin walled hollow circular cross-sectional cylindrical inner electrode coaxially surrounding said cold cathode, said inner electrode connected to the load;
a highly charged aluminum hollow circular cross-sectional cylindrical outer electrode coaxially surrounding said inner electrode;
means for maintaining an evacuated region between said cold cathode and said inner electrode;
means for maintaining a gas filled region between said inner electrode and said outer electrode; and
means for providing a high voltage pulse between said cold cathode and said inner electrode to cause electrons to be emitted from said cold cathode and accelerated toward said inner electrode through said evacuated region maintained therebetween with sufficient quantities of electrons passing therethrough to cause secondary electron emission and a volumetric discharge in said gas filled region maintained between said inner electrode and said outer electrode whereby said highly charged outer electrode is discharged to said inner electrode and through the load connected thereto.

10. The high voltage coaxial switch according to claim 9 wherein said solid brass circular cross-sectional cylindrical cold cathode has a plurality of points thereon to aid in electron emission therefrom.

11. The high voltage coaxial switch according to claim 10 wherein said plurality of points on said cold cathode are positioned so as to induce a relatively uniform electron emission in said evacuated region between said cold cathode and said inner electrode.

12. The high voltage coaxial switch according to claim 9 wherein said means for maintaining a gas filled region maintains an air filled region between said inner electrode and said outer electrode.

* * * * *